US006895703B2

(12) United States Patent
Tien

(10) Patent No.: US 6,895,703 B2
(45) Date of Patent: May 24, 2005

(54) IMPELLER MODULE OF SNOW DROP WATER BALL

(76) Inventor: Hsien Tsai Tien, No. 45, 131 Lane, Ming-Fu Road, Hsin-Chu City (TW)

( * ) Notice: Subject to any disclaimer, the term of this patent is extended or adjusted under 35 U.S.C. 154(b) by 39 days.

(21) Appl. No.: 10/456,466

(22) Filed: Jun. 9, 2003

(65) Prior Publication Data

US 2004/0244243 A1 Dec. 9, 2004

(51) Int. Cl.[7] ..... G09F 19/00
(52) U.S. Cl. ..... 40/410; 40/426; 40/406
(58) Field of Search ..... 40/406–410, 426, 40/429, 430

(56) References Cited

U.S. PATENT DOCUMENTS 5,743,780 A * 4/1998 Liu ..... 446/136
5,864,976 A * 2/1999 Yang ..... 40/410
6,588,130 B1 * 7/2003 Yang ..... 40/410

* cited by examiner

*Primary Examiner*—Cassandra Davis
(74) *Attorney, Agent, or Firm*—Birch, Stewart, Kolasch, & Birch, LLP.

(57) ABSTRACT

An impeller module of snow drop water ball includes an magnet driven impeller module attached on the anti-leak rubber plug for propelling the snow drops and turning the decoration in a glass dome. The magnet driven impeller module has a blade ring which is magnetically couple with a magnetic rotor, and drive by the magnetic rotor from outside of the snow drop ball. Using the impeller module embodiment of the present invention, the anti-leak rubber plug shall no longer in need of forming a shaft hole, so as can structurally solve the long-suffering liquid leakage problem of the snow drop water ball and prolonging its service life.

15 Claims, 6 Drawing Sheets

(PROIR ART)

IMPELLER MODULE OF SNOW DROP WATER BALL

BACKGROUND OF THE INVENTION

This invention relates to module applicable to a snow drop water ball structure, particularly to an impeller module driven by a magnetic power transmitted from the outside of the snow water ball.

Illustrated in FIG. 8 is a conventional water ball structure consisting of a base (10), a glass dome (20), and an anti-leak rubber plug (30). The glass dome (20) is filled with a liquid, having an open lower side sealed by anti-leak rubber plug (30) to prevent the liquid leaking out. A decoration (31) is housed in the glass dome and fixed on the rubber plug (30). The rubber plug (30) has an annular curved projection on an outer annular surface to engage an annular convex formed in the open lower side of the glass dome (20), thereby enhancing the mutual contact tightness therein.

Conventional music snow drop ball is also well known in the art, including a driving mechanism for rotating a propeller placed in the water ball. The propeller rotates to drive up the snow drops in the water in accordance with the music emitted from a music bell. A shaft rod is passed through a shaft hole of a rotary tray of a base of the decoration. A clearance exists between the shaft rod and the shaft hole. Therefore, after a period of use, the water in the water ball tends to infiltrate back through the clearance into the driving mechanism. This will lead to rusting of the driving mechanism and affect the operation thereof.

U.S. Pat. No. 5,864,976 by Yang discloses a driving mechanism of music snow drop ball using an upper and lower silicone gaskets to prevent the water leaking from a shaft hole, so as to prevent the drawbacks which could caused by water leaking; however, when the gasket is fastened to bind the shaft rod, the friction between the shaft rod and the silicone gaskets may weakened the rotation of the shaft therein, so as causing the snow drops can be hardly driven up smoothly.

SUMMARY OF THE INVENTION

It is therefore a primary object of the present invention to provide a impeller module which could be driven by a magnetic power transmitted from the outside of the snow water ball, so that could provide waterproof effect and avoid outside driven mechanisms rusting.

According to the above object, the impeller module of music snow drop ball of the present invention includes an magnet driven impeller module which is attached on an anti-leak rubber plug for propelling the flow of the snow drops and rotation of the decoration in the glass dome. The magnet driven impeller module having a ring body provided with a magnetic part driven by a magnetic rotor from outside of the music snow drop ball to form as a magnetic couple, and receiving a rotational power to rotate a blade ring and a rotational disc thereof simultaneously, so as to function as a snow drop water ball and keep the anti-leak rubber plug therein as same as the conventional water ball structure to be integrally without making a shaft hole therein for outside driving mechanism, music bell, driving motor etc., so as to prevent water leaking problems.

The present invention can be best understood through the following description and accompanying drawings, wherein:

DETAILED DESCRIPTION OF THE PREFERRED EMBODIMENT

Figure 1:
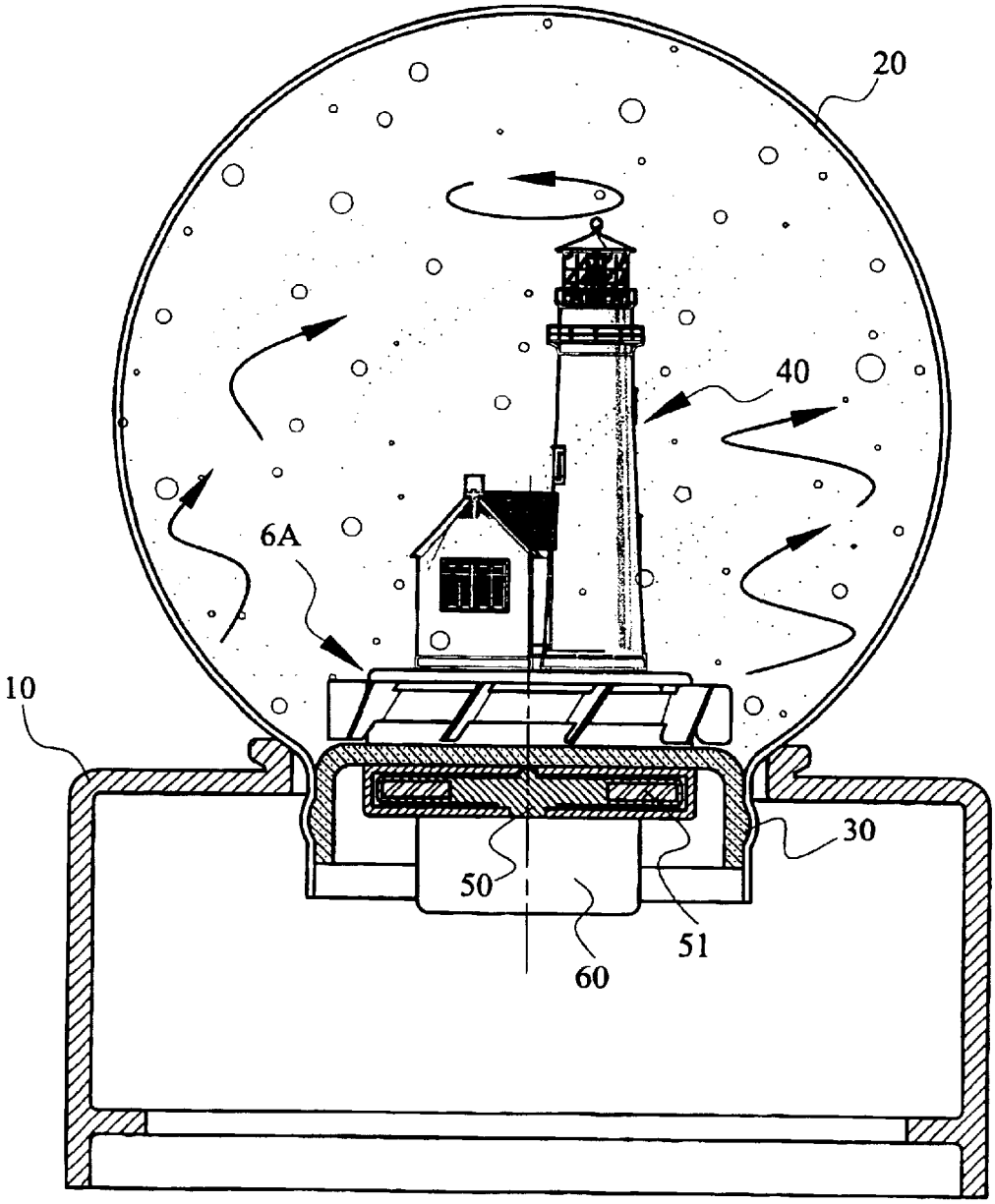
FIG. 1 is a sectional assembled view for illustrating of the use of the first embodiment the present invention.

Referring to FIG. 1, according to the present invention, a snow drop water ball may consisting of a base (10), a glass dome (20), an impeller module (6A) with inclined blades, a magnet rotor (50) driven by a music bell (60) and an anti-leak rubber plug (30). The glass dome (20) is filled with a liquid and a plurality of snow-like impurities, and having an open lower side sealed by anti-leak rubber plug (30) to prevent the liquid leaking out. A decoration (40) is housed in the glass dome and fixed on the top of the impeller module (6A).

Figure 2:
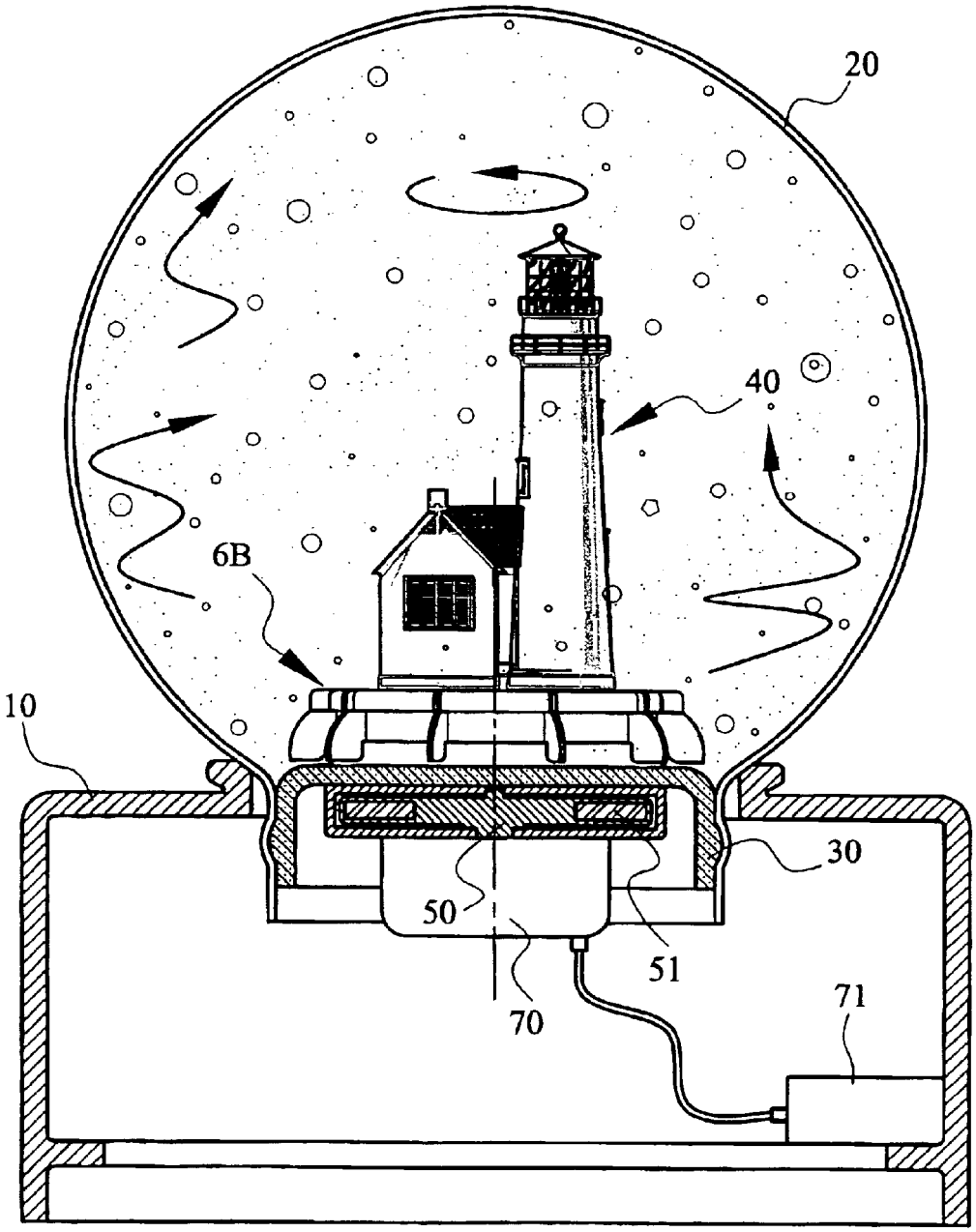
FIG. 2 is a sectional assembled view for illustrating of the use of the second embodiment the present invention.

Referring to FIG. 2, according to the present invention, a snow drop water ball may consisting of a base (10), a glass dome (20), an impeller module (6B) with double blade ring, a magnet rotor (50) and an anti-leak rubber plug (30). The glass dome (20) is filled with a liquid and a plurality of snow-like impurities, and having an open lower side sealed by anti-leak rubber plug (30) to prevent the liquid leaking out. A decoration (40) is housed in the glass dome (20) and fixed on the top of the impeller module (6B). The magnet rotor (50) is driven by a drive motor (70) which connect to a power supply unit (71). The power supply unit (71) can be an AC power, DC power or either therein.

Figure 3:
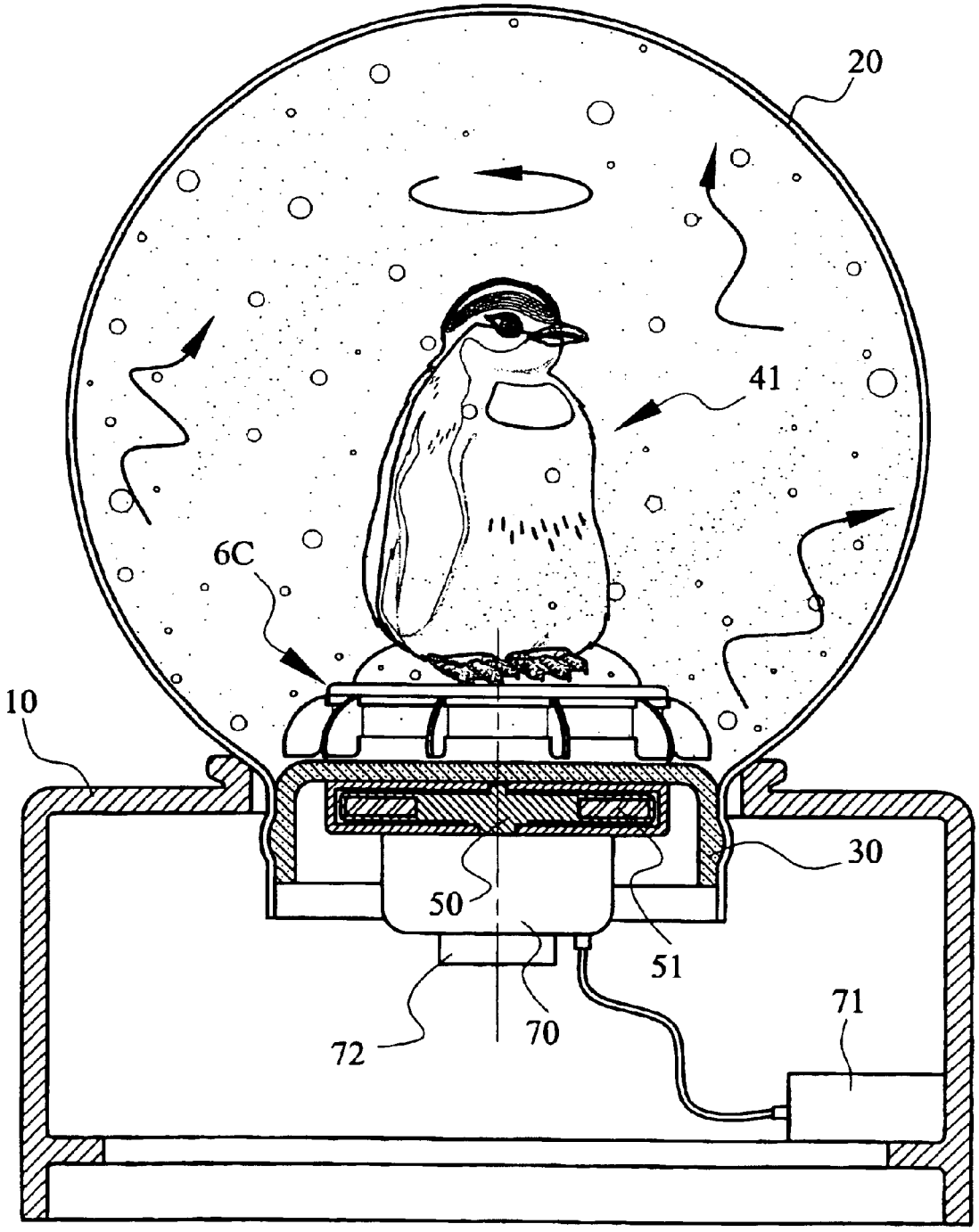
FIG. 3 is a cross-sectional assembled view for illustrating of the use of the third embodiment the present invention.

Referring to FIG. 3, according to the present invention, a snow drop water ball may also consisting of a base (10), a glass dome (20), an impeller module (6C) with single blade ring, a magnet rotor (50), and an anti-leak rubber plug (30). The glass dome (20) is filled with a liquid and a plurality of snow-like impurities, and having an open lower side sealed by anti-leak rubber plug (30) to prevent the liquid leaking out. A decoration (41) is housed in the glass dome (20) and fixed on the top of the impeller module (6B). The magnet rotor (50) is driven by a drive motor (70) which been connected to a power supply unit (71). Further, there is a music instrument (72) provided to play music according to the rotation of drive motor (70).

The decorations (40) and (41) illustrated above can be varied in different shaped and quantities according to the requirement of the manufacture in order to achieve the variation of the overall formation.

As shown in above illustrated, the magnet rotor (50) can be configured basically in a disc body shape coupled to and rotatable with a shaft which connect to music bell (60) or drive motor (70), and including a plurality of permanent magnetic (51) arranged in a circular array. Preferably, the disc body of the magnet rotor (50) may be made from polymeric, for example, polyolefin, such as polypropylene and the like, and encapsulates the circular array of permanent magnetic (51). The fabrication of the magnet rotor (50) provided can using various encapsulation techniques, many of which are well known and conventional in the art. Injection or insert molding may be employed to provide the magnet rotor (50).

Figure 7:
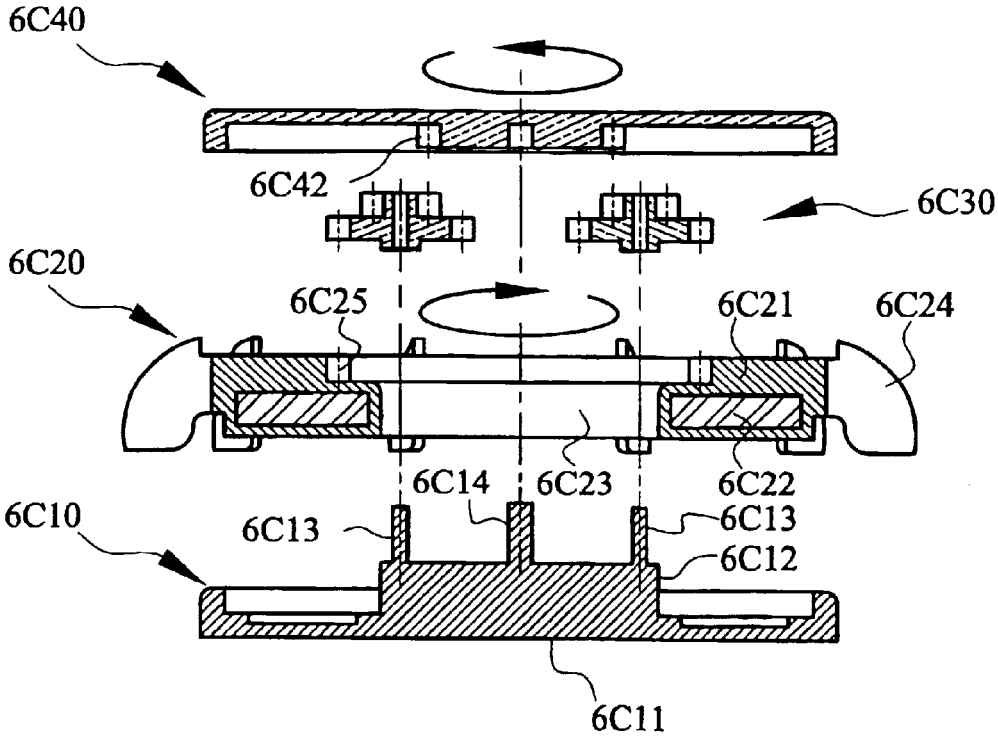
FIG. 7 is an exploded cross-sectional view of the impeller module with single blade ring of the second embodiment the present invention.
Figure 8:
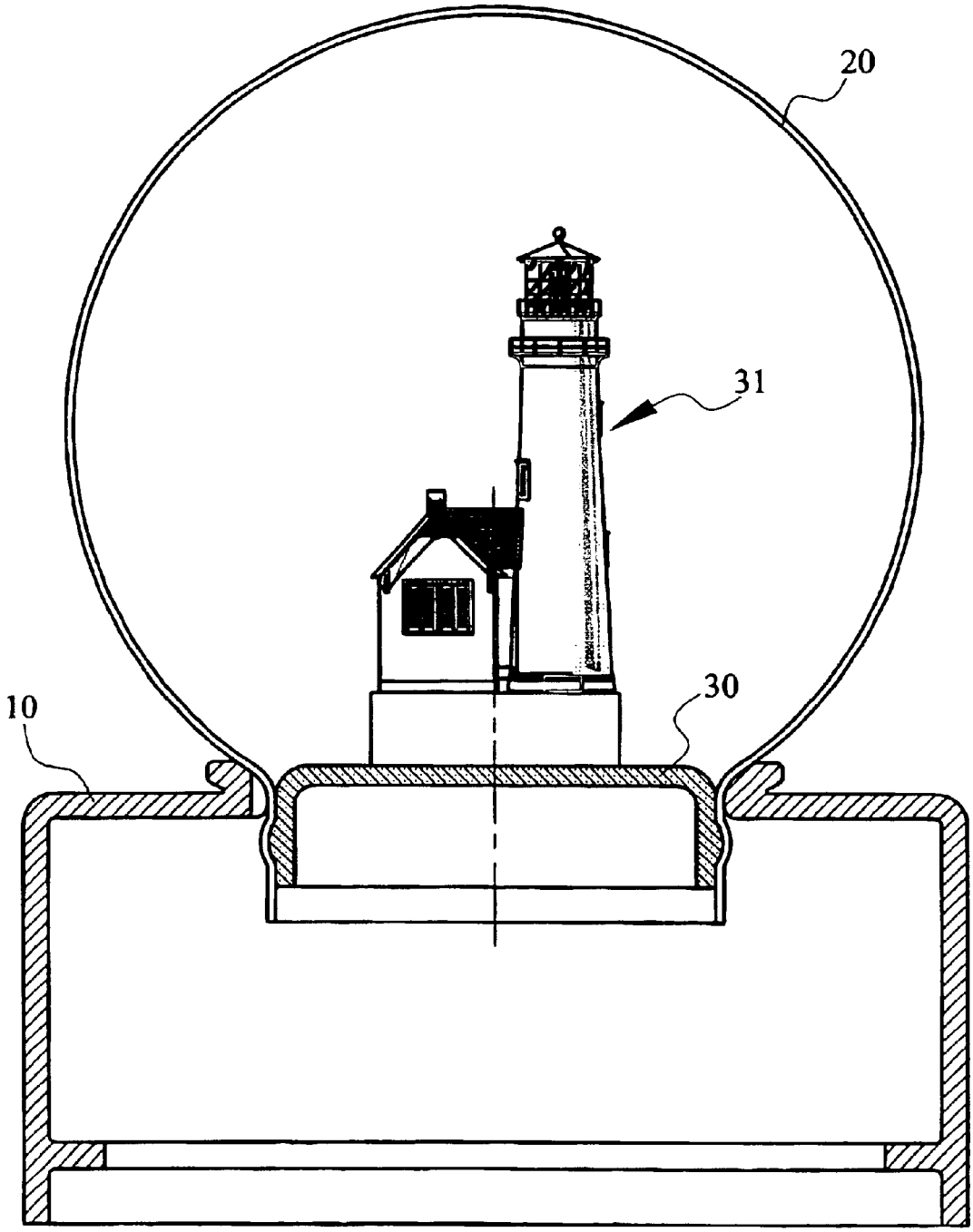
FIG. 8 is a cross-sectional view of a conventional water ball decoration.

Referring now to FIGS. 7–8, according to the present invention, is a second embodiment of the impeller module (6B) with double blade ring comprising: a base disc (6B10), a blade ring (6B20), a gear system (6B30) and a rotational disc (6B40). The base disc (6B10) is fixedly connect to an anti-leak rubber plug (30) at the bottom surface (6B11) thereof and formed with a bearing surface (6B12) on a spindle portion. A Pin or a plurality of Pins (6B13) and a central post (6B14) protrude beyond the base disc (6B10) for rotatably supporting the gear system (6B30) and the rotational disc (6B40) thereon.

The blade ring (6B20) comprising a ring body (6B21) having a spindle hole (6B23) for rotatably mounted on the bearing surface (6B12). A plurality of permanent magnets (6B22) connected to the ring body (6B21) and arranged in a circular array for receiving the rotational power with a magnetic coupling from the magnet rotor (50). A set of blades (6B24) extending radially from the periphery of ring body (6B21) for propelling and forcing the snow-like impurities flying over and over in the liquid of the snow drop ball.

The blade ring (6B20) having a inner gear (6B25) for meshing with the gear system (6B30) and transmitting the rotational power from the magnet rotor (50) to rotate the rotational disc (6B40).

The rotational disc (6B40) is rotatably supported by the central post (6B14), and having a gear portion (6B42) adapted to mesh with gear system (6B30). Therefore, when the magnet rotor (50) rotates, the ring body (6B21) and the rotational disc (6B40) will turn in different velocities and/or different directions, that would carry the blades (6B24) to fan up the snow-like impurities and rotate the decoration on the top of the rotational disc (6B40).

For enhancing the fan up effect, in a still further arrangement, the rotational disc (6B40) can further comprising a set of blades (6B43) extending radially from the periphery thereof, that would urge the flying of snow-like impurities more turbulently.

Figure 4:
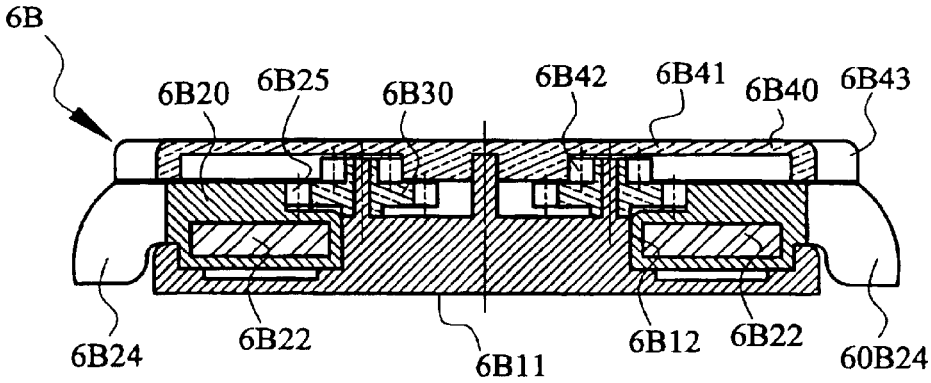
FIG. 4 is a cross-sectional assembled view of an impeller module with double blade ring of the second embodiment the present invention.
Figure 5:
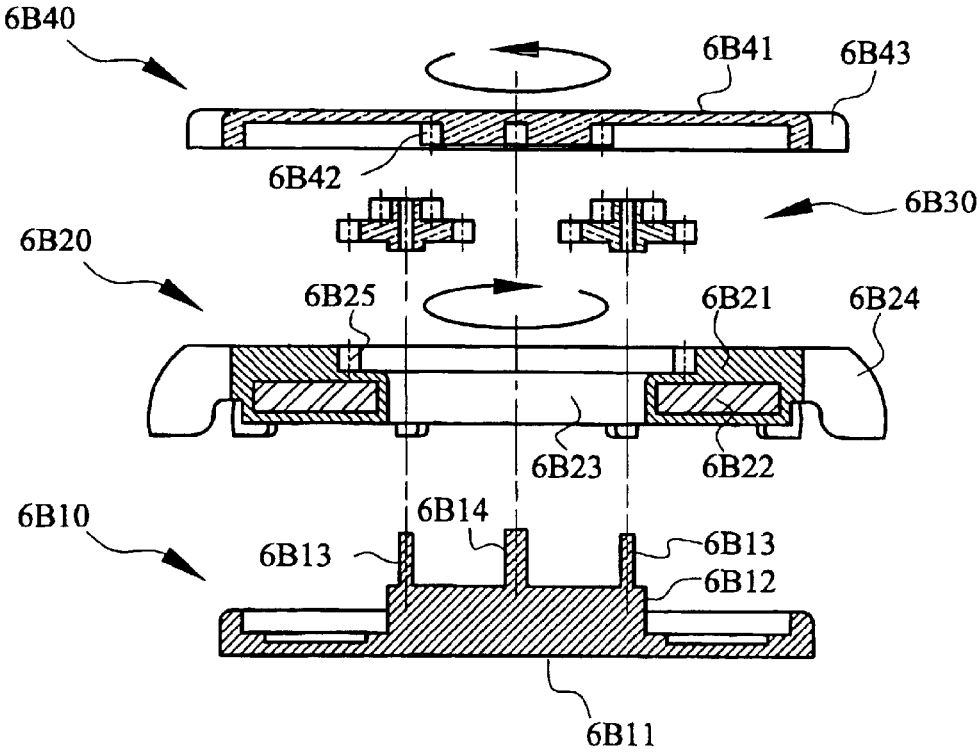
FIG. 5 is an exploded cross-sectional view of the impeller module with double blade ring of the second embodiment the present invention.
Figure 6:
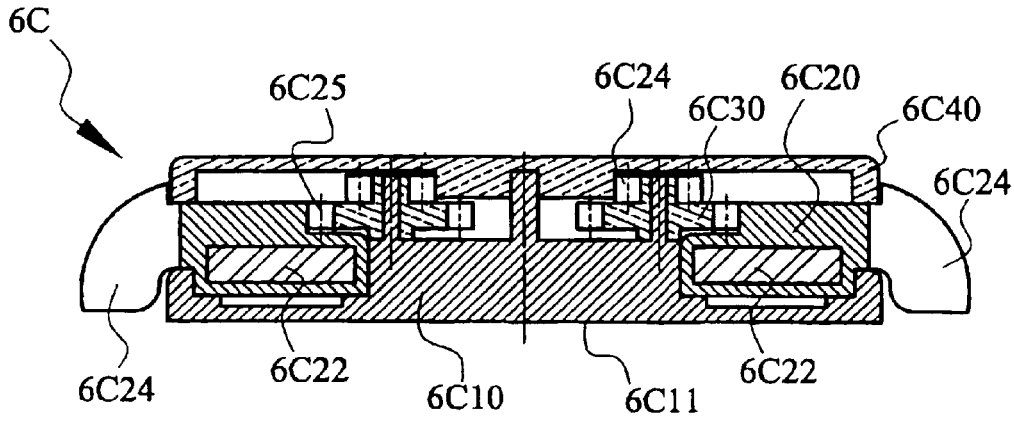
FIG. 6 is a cross-sectional assembled view of an impeller module with single blade ring of the second embodiment the present invention.

Referring now to FIGS. 4–5, according to the present invention, is a third embodiment of the impeller module (6C) with single blade ring comprising: a base disc (6C10), a blade ring (6C20), a gear system (6C30) and a rotational disc (6C40). The base disc (6C10) is fixedly connect to an anti-leak rubber plug (30) at the bottom surface (6C11) thereof and formed with a bearing surface (6C12) on a spindle portion. A Pin or a plurality of Pins (6C13) and a central post (6C14) protrude beyond the base disc (6C10) for rotatably supporting the gear system (6C30) and the rotational disc (6C40) thereon.

The blade ring (6C20) comprising a ring body (6C21) having a spindle hole (6C23) for rotatably mounted on bearing surface (6C12). A plurality of permanent magnets (6C22) connected to the ring body (6C21) and arranged in a circular array for receiving the rotational power with a magnetic coupling from the magnet rotor (50). A set of blades (6C24) extending radially from the periphery of ring body (6C21) for propelling and forcing the snow-like impurities flying over and over in the liquid of the snow drop ball.

The blade ring (6C20) having a inner gear (6C25) for meshing with the gear system (6C30) and transmitting the rotational power from the magnet rotor (50) to rotate the rotational disc (6C40).

The rotational disc (6C40) is rotatably supported by the central post (6C14), and having a gear portion (6C42) adapted to mesh with gear system (6C30). Therefore, when the magnet rotor (50) rotates, the ring body (6C21) and the rotational disc (6C40) will turn in different velocities and/or different directions, that would carry the blades (6C24) to fan up the snow-like impurities and rotate the decoration on the top of the rotational disc (6C40).

Referring to FIGS. 4–7, it is recommended that the ring body (6B21), (6C21) be manufactured from nylon or polymeric, for example, polyolefin, such as polypropylene and the like, and encapsulates the circular array of permanent magnetic (6B22), (6C22). The fabrication of the ring body (6B21), (6C21) can using various encapsulation techniques, many of which are well known and conventional in the art. Injection or insert molding may be employed to provide the ring body (6B21), (6C21). Preferably, the ring body and the blade ring (6C20) are integrally formed as an structure.

As can be understood from the above description, while a conventional water ball add the snow-like impurities and the impeller module (6A) according to the present invention, that would turn to be a snow drop water ball. Compare to the prior art, to use this invention, the anti-leak rubber plug no longer to need a shaft hole, so as to prevent liquid leakage from the glass dome and prolonging service life of snow drop water ball.

While the preferred embodiments of the invention have been described above, it will be recognized and understood that various modifications may be made therein and the appended claims are intended to cover all such modifications which may fall within the spirit and scope of the invention.

Parts List

10 a base
20 a glass dome
30 an anti-leak rubber plug
31 a decoration
40 a decoration
41 a decoration
50 a magnet rotor
51 a permanent magnet
60 a music bell
70 a drive motor
71 a power supply unit
72 a music instrument
6A an impeller module with inclined blades
6B an impeller module with double blade ring
6B10 a base disc
6B11 a bottom surface
6B12 a bearing surface
6B13 a pin
6B14 a central post
6B20 a blade ring
6B21 a ring body
6B22 a permanent magnet
6B23 a spindle hole
6B24 a set of blades
6B25 a inner gear
6B30 a gear system
6B40 a rotational disc
6B41 a top surface
6B42 a gear portion
6B43 a set of blades
6C an impeller module with single blade ring
6C10 a base disc

6C11 a bottom surface
6C12 a bearing surface
6C13 a pin or pins
6C14 a central post
6C20 a blade ring
6C21 a ring body
6C22 a permanent magnet
6C23 a shaft hole
6C24 a set of blades
6C25 a inner gear
6C30 a gear system
6C40 a rotational disc
6C41 a top surface
6C42 a gear portion
6C43 a set of blades

What is claimed is:

1. An impeller module of snow drop water ball driven by a magnet rotor from outside of the snow drop water ball, comprising:

a base disc connected to the snow drop water ball and having a spindle with a bearing surface, a plurality of pins and a central post;

a blade ring having a ring body with a spindle hole for rotatably mounted on the bearing surface, a plurality of magnet elements, an inner gear and a set of blades, and using the magnet elements to receive a rotational power via a magnetic coupling effect from a magnet rotor;

a gear system rotatably supported by the pins and meshed with the inner gear; and a rotational disc rotatably supported by the central post and having a top surface and gear portion, the rotational disc using the a top surface to support an decoration of the snow drop water ball, the gear system transmitting the rotational power from the blade ring to the rotational disc, the rotational disc using the gear portion to engage with the gear system for receiving the rotational power from the gear system.

2. An impeller module of snow drop water ball according to claim 1 in which said snow drop water ball has a glass dome, and an anti-leak rubber plug, and filled with a liquid and a plurality of snow-like impurities.

3. An impeller module of snow drop water ball according to claim 1 in which said blades are inclined relative to the spindle of the base disc.

4. An impeller module of snow drop water ball according to claim 1 in which said rotational disc further comprising a set of blades.

5. An impeller module of snow drop water ball according to claim 1 in which said magnet rotor is driven by a traditional music bell.

6. An impeller module of snow drop water ball according to claim 1 in which said magnet rotor is driven by a drive motor.

7. An impeller module of snow drop water ball according to claim 1 in which said magnet elements is a plurality of permanents arranged in a circular array.

8. An impeller module of snow drop water ball according to claim 1 in which said ring body is manufactured from nylon or polymeric, and encapsulates the magnet elements.

9. An impeller module of snow drop water ball according to claim 1 in which said blades is extending radially from the periphery of the ring body.

10. An impeller module of snow drop water ball, comprising:

a magnet rotor disposed on outside of the snow drop water ball and having a disk body comprising a plurality of permanent magnets, said magnet rotor coupled to and rotatable with a shaft which connected to a music bell;

a base disc connected to the snow drop water ball and having a spindle with a bearing surface, a plurality of pins and a central post;

a blade ring having a ring body with a spindle hole for rotatably mounted on the bearing surface, a plurality of magnet elements, an inner gear and a set of blades, and using the magnet elements to receive a rotational power via a magnetic coupling effect from the magnet rotor;

a gear system rotatably supported by the pins and meshed with the inner gear; and a rotational disc rotatably supported by the central post and having a top surface and gear portion, the rotational disc using the a top surface to support an decoration of the snow drop water ball, the gear system transmitting the rotational power from the blade ring to the rotational disc, the rotational disc using the gear portion to engage with the gear system for receiving the rotational power from the gear system.

11. An impeller module of snow drop water ball according to claim 10 in which said blades is inclined relative to the spindle of the base disc.

12. An impeller module of snow drop water ball according to claim 10 in which said rotational disc further comprising a set of blades.

13. An impeller module of snow drop water ball, comprising:

a magnet rotor disposed on outside of the snow drop water ball and having a disk body comprising a plurality of permanent magnets, said magnet rotor coupled to and rotatable with a shaft which connected to a motor;

a base disc connected to the snow drop water ball and having a spindle with a bearing surface, a plurality of pins and a central post;

a blade ring having a ring body with a spindle hole for rotatably mounted on the bearing surface, a plurality of magnet elements, an inner gear and a set of blades, and using the magnet elements to receive a rotational power via a magnetic coupling effect from the magnet rotor;

a gear system rotatably supported by the pins and meshed with the inner gear; and a rotational disc rotatably supported by the central post and having a top surface and gear portion, the rotational disc using the a top surface to support an decoration of the snow drop water ball, the gear system transmitting the rotational power from the blade ring to the rotational disc, the rotational disc using the gear portion to engage with the gear system for receiving the rotational power from the gear system.

14. An impeller module of snow drop water ball according to claim 13 in which said blades is inclined relative to the spindle of the base disc.

15. An impeller module of snow drop water ball according to claim 13 in which said rotational disc further comprising a set of blades.

* * * * *